US006033508A

United States Patent [19]

Taniguchi et al.

[11] Patent Number: 6,033,508

[45] Date of Patent: Mar. 7, 2000

[54] METHOD AND APPARATUS FOR MANUFACTURING RIBBON ROLL

[75] Inventors: Yoshimasa Taniguchi; Akihiro Kaneko; Tetsuji Ishikawa; Seiji Gunji, all of Tochigi, Japan

[73] Assignee: Sony Chemicals Corp., Tochigi, Japan

[21] Appl. No.: 09/041,688

[22] Filed: Mar. 13, 1998

[51] Int. Cl.[7] ..... B31F 5/00

[52] U.S. Cl. ..... 156/159; 156/266; 156/267; 156/304.3; 156/506; 156/507; 156/517

[58] Field of Search ..... 156/157, 159, 156/264, 267, 304.1, 304.3, 505, 506, 507, 502, 517, 266

[56] References Cited

U.S. PATENT DOCUMENTS 4,501,630 2/1985 Kiuchi ..... 156/159
4,801,342 1/1989 Wheeler et al. ..... 156/159
5,064,488 11/1991 Dickey ..... 156/159
5,389,189 2/1995 Matsuyama et al. ..... 156/506
5,698,060 12/1997 Long ..... 156/304.3

*Primary Examiner*—James Sells
*Attorney, Agent, or Firm*—Hill & Simpson

[57] ABSTRACT

A method of manufacturing a ribbon roll by joining a splice tape to a ribbon, is capable of accomplishing automatization to deal with splice tapes different in length and kind. This method comprises a ribbon supply process, an edit process for joining first and second splice tapes to the ribbon and a take-up process for rolling up the ribbon joined to the first and second splice tapes. In the edit process, the first and second splice tapes are joined by an adhesive tape sticking section and its feeding quantity is adjusted by an accumulator. On the other hand, the ribbon is drawn out by a given length from a supply unit and cut. A rotating bed 42 supporting the cut ribbon is rotated so that the end of the cut ribbon comes into an opposed relation to the end of the first or second splice tape. In this state, the ribbon and the splice tape are joined to each other.

18 Claims, 11 Drawing Sheets

METHOD AND APPARATUS FOR MANUFACTURING RIBBON ROLL

BACKGROUND OF THE INVENTION

1. Field of the Invention

The present invention relates to a method and apparatus for manufacturing a ribbon roll which is made by rolling up an ink ribbon, a magnetic tape, a paper tape or the like, and more particularly to a ribbon roll manufacturing method and apparatus which are capable of, when manufacturing a ribbon roll by conducting an edit process of joining a plurality of ribbon materials and then by rolling up or winding the resultant ribbon around a core, easily accomplishing the edit process for a short time.

2. Description of the Related Art

In general, as an ink ribbon for use in recording based upon thermal transfer, there has been employed an ink ribbon roll made by rolling a strip ink ribbon around a core. In addition, as the ink ribbon roll, in place of directly rolling up only a strip ink ribbon on a core, one produced by joining or splicing a splice tape such as a trailer tape and a leader tape to an ink ribbon in accordance with the specification of a printer using the ink ribbon before rolling-up has come into widespread use.

For instance, as shown in FIG. 7, trailer tapes 2, leader tapes 3 and intermediate tapes 4 are adhered to ink ribbons 1 with adhesive tapes 5 (5*a* to 5*d*) and the resultant due to the adhesion is cut along a cutting plane line indicated at character A and rolled around a core 6 to produce an ink ribbon roll, which is put to use. In this case, a way of rolling it up is usually taken as follows.

First of all, the trailer tape 2, the ink ribbon 1 and the leader tape 3 are successively rolled up in a state where one end portion of the trailer tape 2 on the core 6 side of the cutting plane line A is fixed through the adhesive tape 5*a* to the core 6. Secondly, the intermediate tape 4 is peeled off the adhesive tape 5*d* which in turn, is used to fix the wound leader tape 3. On the other hand, the remaining portion of the intermediate tape 4 cut along the cutting plane line A is peeled off the adhesive tape 5*a* when the trailer tape 2 succeeding the cutting plane line A is adhered to a different core, and the adhesive tape 5*a* is used to fix the trailer tape 2 to the different core. Thereafter, as in the case mentioned above, the trailer tape 2, the ink ribbon 1 and the leader tape 3 are successively rolled up around a core. With the repeated same operations, a large number of ribbon rolls are producible.

In this case, the leader tape is employed to join the ink ribbon to a printer when necessary, while the trailer tape is used to allow a sensor within the printer to sense the ribbon end of the ink ribbon mounted on the printer, when needed.

FIG. 8 is an illustration of an arrangement of an apparatus of manufacturing an ink ribbon roll in which the trailer tape and the leader tape are adhered to each other as mentioned above. The apparatus shown in this illustration is composed of a supply (unroll) unit 10, an edit unit 20 and a take-up unit 30.

The supply unit 10 is made up of an ink ribbon supply shaft 11 supporting a rolled ribbon material (a ribbon to be supplied as a material for manufacturing a ribbon roll) and a nip roller 12 for partially drawing out the ink ribbon 1 from the rolled ribbon on the supply shaft 11.

The edit unit 20 conducts an edit process to join a leader tape 3, an intermediate tape 4 and a trailer tape 2 to the ink ribbon 1 unrolled from the supply unit 10.

FIGS. 9A and 9B are illustrations available for a description of the edit process to be conducted in the edit unit 20 of the FIG. 8 apparatus. As shown in FIG. 9A, the edit unit 20 is equipped with cutting blades 21, 22 for cutting of the ink ribbon 1, while vacuum mechanisms 24 are located on stages 23 so that the ink ribbon 1 in the vicinity of cutting plane lines $A_{21}$, $A_{22}$ along which the ink ribbon 1 is cut by the cutting blades 21, 22 is vacuum-chucked on the stages 23. In addition, in the edit unit 20 there are mounted a rolled leader tape material (a tape to be used as a material for a leader tape in a ribbon roll) 3, a rolled intermediate tape material (a tape to be used as a material for an intermediate tape in a ribbon roll) 4, a rolled trailer tape material (a tape to be used as a material for a trailer tape in a ribbon roll) 2 and rolled adhesive tapes 5 (5*a* to 5*d*) which are supplied at the editing operation.

As shown in FIG. 9A, the ink ribbon 1 is conveyed from the supply unit 10 and the conveyance thereof is stopped at the stages 23 so that the ink ribbon 1 is vacuum-chucked by the vacuum mechanisms 24 and cut at two places by the cutting blades 21, 22, thus removing the ink ribbon 1 portion between both the cutting blades 21, 22.

Subsequently, as shown in FIG. 9B, the leader tape 3, the intermediate tape 4, the trailer tape 2 and the adhesive tapes 5 (5*a* to 5*d*) are drawn out in directions perpendicular to the conveying direction of the ink ribbon 1 and placed on the ink ribbon 1. Whereupon, the take-up unit side ink ribbon 1, the leader tape 3, the intermediate tape 4, the trailer tape 2 and the supply unit side ink ribbon 1 are adhered to each other through the adhesive tapes 5. Further, the edge sides of the tapes placed thereon are cut to coincide in position with the edge side of the ink ribbon 1. Then, the ink ribbon 1 is released from the vacuumized condition to be conveyed to the take-up unit 30.

The take-up unit 30 includes a cutting section 31 in which a plurality of cutting blades are arranged in its width directions to cut the ink ribbon 1, carrying the leader tape 3, the intermediate tape 4 and the trailer tape 2 thereon, to have a given width. Further, this take-up unit 30 has turrets 32 each for allowing a plurality of cores 6 to be mounted thereon, and each of the turrets 32 is made to be rotatable around a shaft 33 to successively position the cores 6 which roll up the cut ink ribbons 1 with the given width. Accordingly, the ink ribbons are rolled up around the cores 6, thus manufacturing ink ribbon rolls.

Although in FIG. 8 the take-up unit 30 has been illustrated as including two turrets 32, there is no limitation in the number of cores 6 mounted on the turret 32 and the number of turrets 32 set in the take-up unit 30.

Furthermore, when the ink ribbon 1 is wound around the core 6 in the take-up unit 30, the intermediate tape 4 is cut (see the cutting plane line A in FIG. 7) so that the winding operation starts from the trailer tape 2 and ends at the leader tape 3, and of the cut intermediate tape 4, the intermediate tape 4 portion on the trailer tape 2 side is peeled off the adhesive tape 5*a*, and the trailer tape 2 is adhered to a core through that adhesive tape 5*a*. Further, when the rolling-up of the ink ribbon 1 comes to an end, the intermediate tape 4 on the leader tape 3 side is also peeled off the adhesive tape 5*d* which in turn, is used to fix the wound end thereof.

However, the edit process to be done in the above-described prior edit unit 20 relies on manual works including the cutting of the ink ribbon 1, the drawing-out of the leader tape 3, the intermediate tape 4, the trailer tape 2 and the adhesive tapes 5 (5*a* to 5*d*), the adhesion of these tapes and the cutting for making all of uniform edge sides of the tapes.

These operations need extremely high skill, and therefore, the common workman can not the edit process.

Although a consideration can also be given to automatization of the edit process which has relied on the manual works, the specification required for the ribbon rolls runs into various kinds because the splice tapes necessary are different in type or length from each other among printers. For instance, there is a case that the trailer tape is unnecessary. Accordingly, in order to deal with various specifications necessary for the ribbon rolls, there is a need to change the kind of the splice tape. In addition, the length of the splice tape in the ink ribbon roll corresponds to the width of the rolled splice tape material as found from FIGS. 9A and 9B, and therefore, for changing the length of the splice tape for the connection of the ink ribbon roll, it is necessary to replace the rolled splice tape material with a tape width corresponding to the length of the splice tape in the ink ribbon roll. However, even if merely automatizing the portion of the prior edit process relying upon the manual operations, difficulty is experienced to make the replacement of the rolled splice tape material. Particularly, it is required to change the separation between the cutting blades 21, 22 in accordance with the width of the rolled splice tape material to be put to use, and in the case of automatizing the adjustment of that separation therebetween, the apparatus results in being complicated and large in scale. For this reason, difficulty is encountered to automatize the edit process, and in fact the edit process depends upon the manual operations by the skilled workman under the unavoidable circumstances.

Moreover, even by the skilled workman, while the edit process is done in the edit unit 20, the take-up process for rolling the ink ribbons 1 on the cores 6 is necessary to stop, which makes it difficult to simultaneously conduct the edit process and the take-up process, with the result that it is difficult to improve the productivity on the ribbon rolls.

SUMMARY OF THE INVENTION

Accordingly, the present invention has been developed with a view to eliminating the problems inherent to the prior art, and it is an object of this invention to automatize the edit process to cope with the situation that splice tapes are different in length and type, in the case of manufacturing a ribbon roll in which a splice tape is joined to a ribbon, such as manufacturing an ink ribbon roll, thus enhancing the productivity on the ribbon roll.

For the completion of this invention, the present inventors have found out the following facts. That is, in the edit process of joining a splice tape to a ribbon, if the splice tape is drawn out in a direction perpendicular to the conveying direction of the ribbon to be joined thereto, the width of the rolled splice tape material restricts the length of the splice tape joined to the ribbon in the longitudinal direction of the ribbon. On the other hand, if the splice tape is drawn out in the direction being the same as the ribbon conveying direction to be joined thereto, without the restriction from the width of the rolled splice tape material, the splice tape having an arbitrary length can be joined to the ribbon, and the automatization of the edit process is easily achievable in this way. In addition, if the splice tape edit process of drawing out the splice tape from the rolled splice tape material to cut it in a given length and of joining a plurality of types of splice tapes to each other when needed is separately done in parallel to the take-up process of rolling the ribbon on a core, the productivity on the ribbon roll is improvable.

More specifically, in accordance with the present invention, a first ribbon roll manufacturing method suitable for manufacturing a ribbon roll by joining a single splice tape to a ribbon, comprises: (I) a ribbon supply process of drawing out and supplying a ribbon from a rolled ribbon material made by rolling up the ribbon; (II) an edit process of cutting the supplied ribbon along its width direction and further of joining a splice tape with a given length to the cut ribbon so that the splice tape is put between the cut ribbon sections; and (III) a take-up process of rolling up the ribbon in a state where the splice tape is interposed between the cut ribbon sections, wherein the edit process (II) comprising: (1) a splice tape edit step of drawing out the splice tape from a rolled splice tape material made by rolling up the splice tape to temporarily fix an end portion of the splice tape drawn out therefrom to a splice tape fixing means; (2) a ribbon conveyance step of conveying the ribbon with a given length from a supply unit to a take-up unit and then of temporarily fixing the ribbon to a ribbon supply side fixing means and a ribbon take-up side fixing means which are disposed to made a separation therebetween in the ribbon conveyance path and further of cutting the ribbon at a position between the ribbon supply side fixing means and the ribbon take-up side fixing means; and (3) a joining step between the splice tape and the ribbon, including the steps of: moving the splice tape fixing means and the ribbon supply side fixing means so that the ribbon supply side fixing means to which the ribbon is fixed is replaced with the splice tape fixing means to which the end portion of the splice tape is fixed; joining the ribbon fixed to the ribbon take-up side fixing means to the splice tape fixed to the splice tape fixing means; releasing the ribbon and the splice tape from the fixing on the ribbon take-up side fixing means and the splice tape fixing means, respectively, to deliver the ribbon joined to the splice tape by a given length in a ribbon take-up direction; temporarily fixing the splice tape to the ribbon take-up side fixing means and further to the splice tape fixing means to cut the splice tape between the ribbon take-up side fixing means and the splice tape fixing means; moving the ribbon supply side fixing means and the splice tape fixing means so that the splice tape fixing means to which the splice tape is fixed is replaced with the ribbon supply side fixing means to which the ribbon is fixed; and joining the splice tape fixed to the ribbon take-up side fixing means to the ribbon fixed to the ribbon supply side fixing means.

Furthermore, in accordance with the present invention, a second ribbon roll manufacturing method suitable for using a splice tape drawn out from a single rolled splice tape material as a plurality of splice tapes different in application from each other, comprises: (I) a ribbon supply process of drawing out and supplying a ribbon from a rolled ribbon material made by rolling up the ribbon; (II) an edit process of cutting the supplied ribbon along its width direction and further of joining a splice tape with a given length to the cut ribbon so that the splice tape is put between the cut ribbon sections; and (III) a take-up process of rolling up the ribbon in a state where the splice tape is interposed between the cut ribbon sections, wherein the edit process (II) comprising: (1) a splice tape edit step including the steps of drawing out the splice tape from a rolled splice tape material made by rolling up the splice tape to temporarily fix an end portion of the splice tape drawn out therefrom to a splice tape fixing means, with the splice tape fixing means being composed of splice tape front-side fixing means and splice tape rear-side fixing means which are disposed to make a separation therebetween in a splice tape conveyance path, and the splice tape rear-side fixing means being placed on the rolled splice tape material side with respect to the splice tape front-side fixing means; cutting the splice tape at a position between the splice tape rear-side fixing means and the splice tape front-side fixing means; joining the splice tape cut into two portions; releasing the splice tape from the fixing to the splice tape fixing means to return the splice tape so that an end portion of the splice tape on the splice tape front-side fixing means coincides in position with an end portion of the splice tape rear-side fixing means on the splice tape front-side fixing means side; and temporarily fixing the splice tape onto the splice tape rear-side fixing means again; (2) a ribbon conveyance step of conveying the ribbon with a given length from a supply unit to a take-up unit and then of temporarily fixing the ribbon to a ribbon supply side fixing means and a ribbon take-up side fixing means which are disposed to made a separation therebetween in the ribbon conveyance path and further of cutting the ribbon at a position between the ribbon supply side fixing means and the ribbon take-up side fixing means; and (3) a joining step between the splice tape and the ribbon, including the steps of: moving the splice tape rear-side fixing means and the ribbon supply side fixing means so that the ribbon supply side fixing means to which the ribbon is fixed is replaced with the splice tape rear-side fixing means to which the splice tape is fixed; joining the ribbon fixed to the ribbon take-up side fixing means to the splice tape fixed to the splice tape rear-side fixing means; releasing the ribbon and the splice tape from the fixing on the ribbon take-up side fixing means and the splice tape rear-side fixing means, respectively; delivering the ribbon joined to the splice tape by a given length in a ribbon take-up direction; temporarily fixing the splice tape to the ribbon take-up side fixing means and further to the splice tape rear-side fixing means to cut the splice tape between the ribbon take-up side fixing means and the splice tape rear-side fixing means; moving the ribbon supply side fixing means and the splice tape rear-side fixing means so that the splice tape rear-side fixing means to which the splice tape is fixed is replaced with the ribbon supply side fixing means to which the ribbon is fixed; and joining the splice tape fixed to the ribbon take-up side fixing means to the ribbon fixed to the ribbon supply side fixing means.

Still further, in accordance with the present invention, a third ribbon roll manufacturing method suitable for using a plurality of kinds of splice tapes drawn out from a plurality of rolled splice tape materials, comprises: (I) a ribbon supply process of drawing out and supplying a ribbon from a rolled ribbon material made by rolling up the ribbon; (II) an edit process of cutting the supplied ribbon along its width direction and further of joining a splice tape comprising first and second splice tapes having given lengths to the cut ribbon so that the splice tape is put between the cut ribbon sections; and (III) a take-up process of rolling up the ribbon in a state where the splice tape is interposed between the cut ribbon sections, wherein the edit process (II) comprising: (1) a splice tape edit step including the steps of drawing out the first splice tape from a rolled splice tape material made by rolling up the first splice tape to temporarily fix an end portion of the first splice tape through a feed adjusting means to a splice tape rear-side fixing means, the splice tape rear-side fixing means together with a splice tape front-side fixing means constituting a splice tape fixing means, and the splice tape rear-side fixing means being disposed on the rolled splice tape material side with respect to the splice tape front-side fixing means to make a separation therebetween in the splice tape conveyance path; drawing out the second splice tape from a rolled splice tape material made by rolling up the second splice tape; temporarily fixing one end portion of the second splice tape to the splice tape front-side fixing means; joining the second splice tape fixed to the splice tape front-side fixing means to the first splice tape fixed to the splice tape rear-side fixing means; releasing the second splice tape from the fixing to the splice tape front-side fixing means and the first splice tape from the fixing on the splice tape rear-side fixing means to return the splice tape resulting from the joining between the first and second splice tapes by a given length in a direction opposite to the first splice tape drawn direction through the use of the feed adjusting means; temporarily fixing the second splice tape onto the splice tape front-side fixing means and the splice tape rear-side fixing means; cutting the second splice tape at a position between the splice tape front-side fixing means and the splice tape rear-side fixing means; joining the cut second splice tape to return the joined second splice tape in a direction opposite to the first splice tape drawn direction through the use of the feed adjusting means; and temporarily fixing the second splice tape onto the splice tape front-side fixing means and the splice tape rear-side fixing means to cut the second splice tape at a position between the splice tape front-side fixing means and the splice tape rear-side fixing means; (2) a ribbon conveyance step of conveying the ribbon with a given length from a supply unit to a take-up unit and then of temporarily fixing the ribbon to a ribbon supply side fixing means and a ribbon take-up side fixing means which are disposed to made a separation therebetween in the ribbon conveyance path and further of cutting the ribbon at a position between the ribbon supply side fixing means and the ribbon take-up side fixing means; and (3) a joining step between the splice tape and the ribbon, including the steps of moving the splice tape rear-side fixing means and the ribbon supply side fixing means so that the ribbon supply side fixing means to which the ribbon is fixed is replaced with the splice tape rear-side fixing means to which the second splice tape is fixed; joining the ribbon fixed to the ribbon take-up side fixing means to the second splice tape fixed to the splice tape rear-side fixing means; releasing the ribbon and the second splice tape from the fixing on the ribbon take-up side fixing means and the splice tape rear-side fixing means, respectively; delivering the ribbon joined to the second splice tape by a given length in a ribbon take-up direction; temporarily fixing the first splice tape to the ribbon take-up side fixing means and further to the splice tape rear-side fixing means to cut the first splice tape between the ribbon take-up side fixing means and the splice tape rear-side fixing means; moving the ribbon supply side fixing means and the splice tape rear-side fixing means so that the splice tape rear-side fixing means to which the first splice tape is fixed is replaced with the ribbon supply side fixing means to which the ribbon is fixed; and joining the first splice tape fixed to the ribbon take-up side fixing means to the ribbon fixed to the ribbon supply side fixing means.

Preferably, in these manufacturing methods, in the joining step between the splice tape and the ribbon (3), the splice tape fixing means (in the second and third methods, the splice tape rear-side fixing means) and the ribbon supply side fixing means are located on a rotating bed to bed at the same distance with respect to a rotary shaft of the rotating bed, and when the rotating bed is rotated, the splice tape fixing means is replaced with the ribbon supply side fixing means, or the ribbon supply side fixing means is replaced with the splice tape fixing means. Particularly, the rotating bed can be constructed to be an angular-type rotating bed having an intermediately bent cross-sectional configuration. In addition, it is preferable that in these manufacturing methods the joining between the splice tapes and the joining between the ribbon and the splice tape are made through a one-sided adhesive tape.

Moreover, in accordance with this invention, a ribbon roll manufacturing apparatus suitable for conducting the first method according to this invention comprises (I) a ribbon supply unit for drawing out and supplying a ribbon from a rolled ribbon material made by rolling up the ribbon; (II) an edit unit for cutting the supplied ribbon along its width direction and further of joining a splice tape with a given length to the cut ribbon so that the splice tape is put between the cut ribbon sections; and (III) a take-up unit for cutting the ribbon in a state where the splice tape is interposed between the cut ribbon sections, to have a given width and further for rolling up the ribbon around a core, wherein the edit unit (II) comprising: a splice tape supply section for drawing out the splice tape from a rolled splice tape material made by rolling up the splice tape; a splice tape fixing means for temporarily fix an end portion of the splice tape drawn out therefrom; ribbon supply side fixing means and ribbon take-up side fixing means for temporarily fix disposed in a ribbon conveyance path from the supply unit to the take-up unit to make a separation therebetween in the ribbon conveyance path; a ribbon cutting means for cutting the ribbon or the splice tape at a position between the ribbon supply side fixing means and the ribbon take-up side fixing means; a moving means of fixing means for moving the splice tape fixing means and the ribbon supply side fixing means so that the ribbon supply side fixing means is replaced with the splice tape fixing means, and further for returning the ribbon supply side fixing means and the splice tape fixing means to the original positions; and a tape joining means for joining the ribbon fixed to the ribbon take-up side fixing means to the splice tape fixed to the splice tape fixing means, and further for joining the splice tape fixed to the ribbon take-up side fixing means to the ribbon fixed to the ribbon supply side fixing means.

In a ribbon roll manufacturing apparatus according to this invention suitable for conducting the second method according to this invention, the splice tape fixing means is composed of splice tape front-side fixing means and splice tape rear-side fixing means which are disposed to make a separation therebetween in a splice tape conveyance path, with the splice tape rear-side fixing means being placed on the rolled splice tape material side with respect to the splice tape front-side fixing means, and further includes a tape cutting means for cutting the splice tape at a position between the splice tape front-side fixing means and the splice tape rear-side fixing means, and a feed adjusting means for returning the splice tape on the splice tape fixing means in a direction opposite to the splice tape drawn direction.

In a ribbon roll manufacturing apparatus according to this invention suitable for conducting the third method according to this invention, the splice tape supply section includes a first splice tape supply means for drawing out and supplying a first splice tape and a second splice tape supply means for drawing out and supplying a second splice tape, the feed adjusting means being place between the first splice tape supply means and the splice tape rear-side fixing means.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE PREFERRED EMBODIMENTS

A detailed description will be made hereinbelow of the present invention with reference to FIGS. 1 to 6. In these illustrations for explaining this invention, the same numerals as those in the illustrations for describing the prior art designate parts which correspond or substantially correspond to the parts of the prior art.

Figure 1:
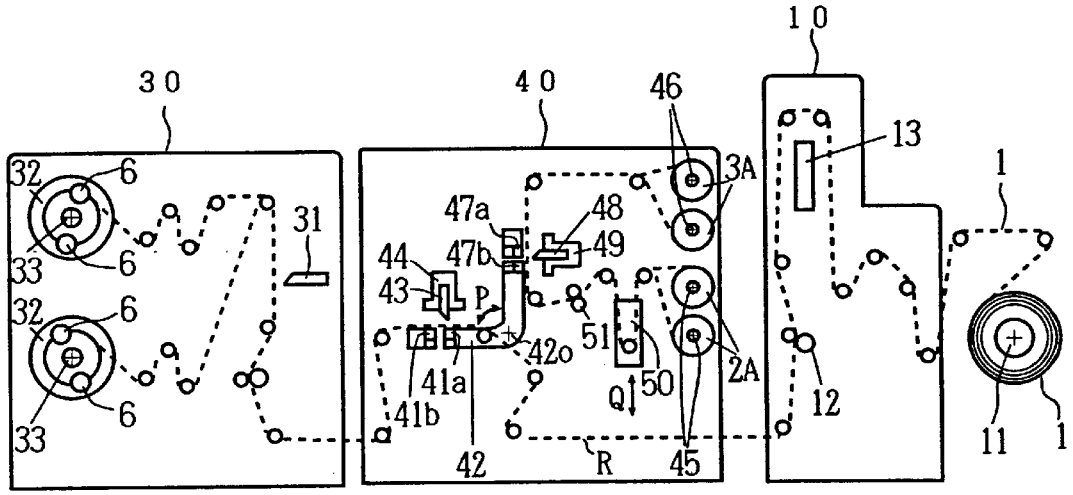
FIG. 1 is an illustration of an arrangement of a ribbon roll manufacturing apparatus according to the present invention.
Figure 7:
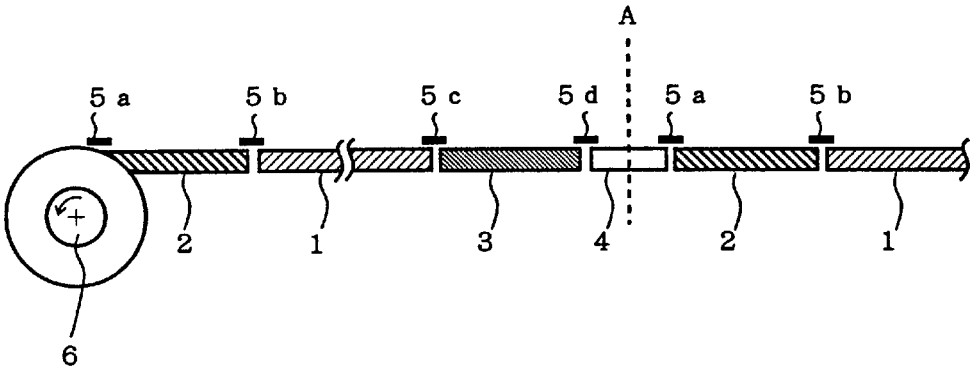
Fig. 7 PRIOR ART
FIG. 7 is an illustration for explaining the join between an ink ribbon and splice tapes which are rolled to produce an ink ribbon roll.

FIG. 1 is an illustration of the whole arrangement of an apparatus for manufacturing a ribbon roll according to an embodiment of the present invention, which allows a third ribbon roll manufacturing method according to this invention. The apparatus shown in this illustration is for the purpose of manufacturing an ink ribbon roll as shown in FIG. 7 in which the rolling-up initiates from a trailer tape 2 and ends at a leader tape 3, as well as the ink ribbon roll to be manufactured in the FIG. 8 apparatus. However, in this apparatus, a first splice tape 2A is employed as a tape constituting the trailer tape 2 while a second splice tape 3A is used as a tape serving as both the leader tape 3 and the intermediate tape 4.

As illustrated, this apparatus comprises a supply unit 10, an edit unit 40 and a take-up unit 30. Of these units, the supply unit 10 and the take-up unit 30 substantially have the same structures as those of the prior apparatus. More specifically, the supply unit 10 is equipped with a supply shaft 11 for supporting a rolled ink ribbon material (primitive ink ribbon) 1 and a nip roller 12 for partially drawing out the ink ribbon 1 from the rolled ink ribbon material to convey it to the edit unit 40. In addition, this supply unit 10 includes a light 13 for illuminating the rolled ink ribbon material to check the coated condition of an ink layer on the drawn ink ribbon 1.

The edit unit 40 is roughly divided into a section for conducting an edit process between the first splice tape 2A and the second splice tape 3A and a section for carrying out a conveyance process for conveying a ribbon with a given length from the supply unit 10 to the take-up unit 30 along a conveyance path R.

In the conveyance path R for the ink ribbon 1 in the ink ribbon conveyance section, a ribbon supply side fixing means 41*a* and a ribbon take-up side fixing means 41*b* are placed as ribbon fixing means for temporarily fixing the ink ribbon 1 onto a bed in a suction way. The ribbon supply side fixing means 41*a* is installed on one end portion of an angular-type rotating bed 42 which is rotatable around a shaft 42*o* in directions indicated at arrows P.

Figure 2:
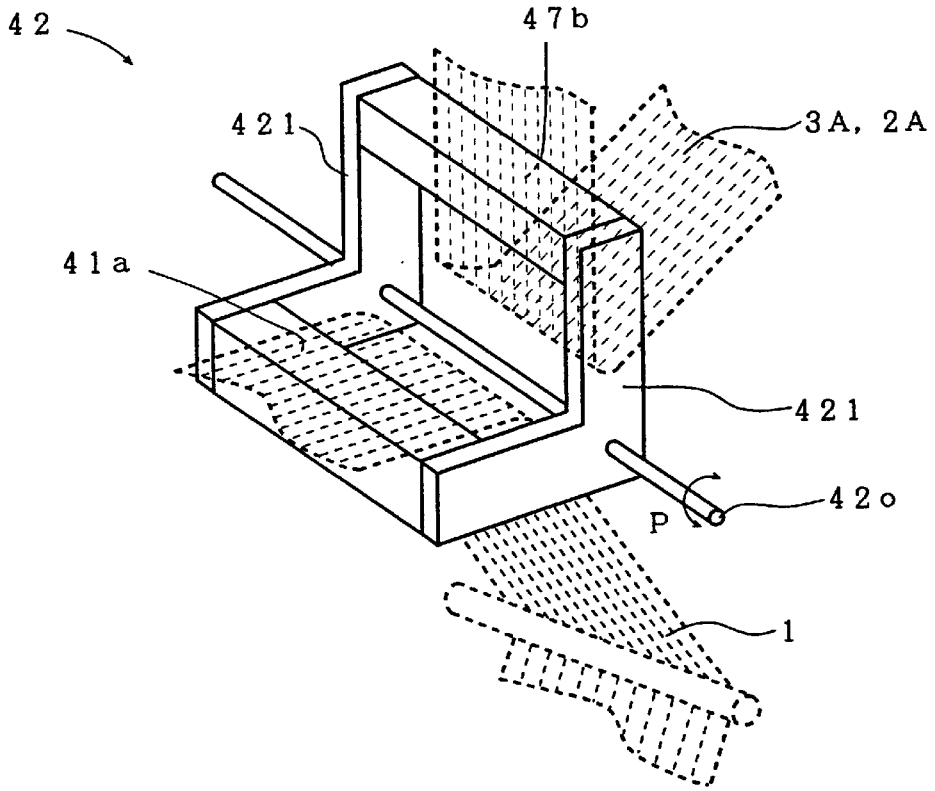
FIG. 2 is a perspective view showing an angular-type rotating bed according to this invention.

FIG. 2 is an illustration for describing this angular-type rotating bed 42 bent at a portion to make a given angle. As illustrated, the angular-type rotating bed 42 has the ribbon supply side fixing means 41*a* at its one end portion between two bent frames 421 being set in opposed relation to each other while having, at its other end portion, a splice tape rear-side fixing means 47*b* which will be mentioned herein later, and further is equipped with the shaft 42*o* serving as the rotational center and fitted to the central portions of the bent frames 421. In this angular-type rotating bed 42, the ink ribbon 1 is conveyed to the take-up unit 30 side to pass between the shaft 42*o* and the ribbon supply side fixing means 41*a*, and is fixed to the ribbon supply side fixing means 41*a* in a suction way when necessary. In addition, the first splice tape 2A or the second splice tape 3A is conveyed along the outer sides of the bent frames 421, and suction-fixed to the splice tape rear-side fixing means 47*b* when necessary. As will be described herein later, the angular-type rotating bed 42 functions as a moving means of fixing means to shift the positions of the splice tape rear-side fixing means 47*b* and the ribbon supply side fixing means 41*a*. Incidentally, if the moving means of a fixing means is based upon a rotating bed having a splice tape fixing means and a ribbon supply side fixing means located at the equal distance with respect to a rotary shaft, it is possible to realize a compact apparatus structure.

In the edit unit 40, above the ribbon supply side fixing means 41*a* and ribbon take-up side fixing means 41*b*, a cutting blade 43 is provided as a ribbon cutting means to cut the ink ribbon 1 arriving here, and further an adhesive tape sticking means 44 is situated as a tape joining means to join the splice tapes 2A, 3A to the ink ribbon 1.

On the other hand, the section for carrying out the splice tape edit process contains a first rolled splice tape supplying means comprising a winding shaft(s) 45 for supporting a rolled splice tape material made by rolling up the first splice tape 2A to be used as a trailer tape and further contains a second rolled splice tape supplying means comprising a winding shaft(s) 46 for supporting a rolled splice tape material made by rolling up the second splice tape 3A to be used as a tape serving as a leader tape and an intermediate tape. Although in FIG. 1 the edit unit 40 is shown to include two winding shafts 45 for the first splice tape 2A and two winding shafts 46 for the second splice tape 3A, the switching is selectively possible between the winding shafts of the same sort. Accordingly, while being put into operation, immediately after the use of the splice tape 2A or 3A wound around one of the two winding shafts 45 or 46, it is possible to switch over to the splice tape 2A or 3A on the other winding shaft 45 or 46.

Furthermore, in the section for conducting the splice tape edit process, a splice tape front-side fixing means 47*a* and a splice tape rear-side fixing means 47*b* are provided as splice tape fixing means to temporarily fix the first splice tape 2A or the second splice tape 3A in a suction way. The first splice tape 2A side splice tape rear-side fixing means 47*b* is located on the angular-type rotating bed 42 as mentioned before. Above the splice tape fixing means 47*a*, 47*b*, a cutting blade 48 is placed as a tape cutting means to cut the first splice tape 2A or the second splice tape 3A arriving here. In addition, an adhesive tape sticking means 49 is set as a joining means to joining the first splice tape 2A and the second splice tape 3A to each other, and an accumulator 50 and a feed roller 51 are provided as a feed adjusting means to retreat the first and second splice tapes 2A, 3A joined to each other so that its one end portion is positioned at the splice tape rear-side fixing means 47*b*. The accumulator 50 accumulates the splice tape fed by a given length through the feed roller 51 in a manner that it moves up and down as indicated by arrows Q in the illustration.

Figure 3A:
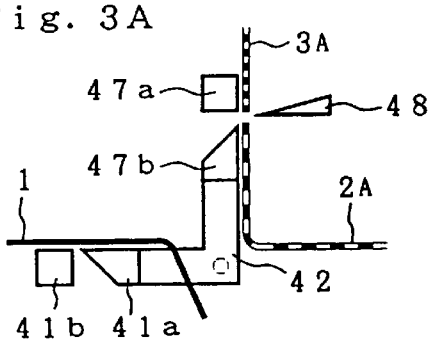
FIGS. 3A to 3U are illustrations useful for explaining an edit process in a ribbon roll manufacturing method according to this invention.
Figure 3E:
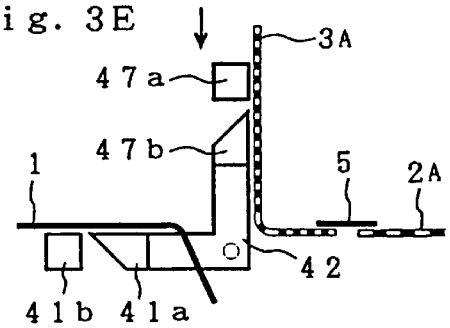
Figure 3B:
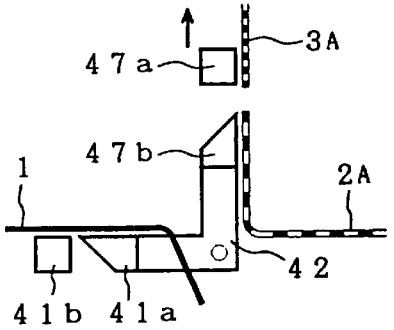
Figure 3F:
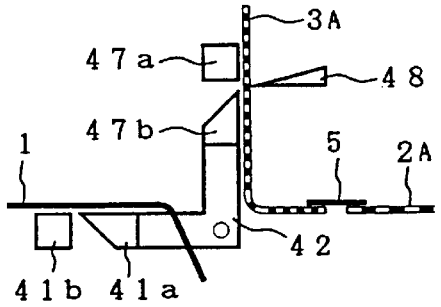
Figure 3C:
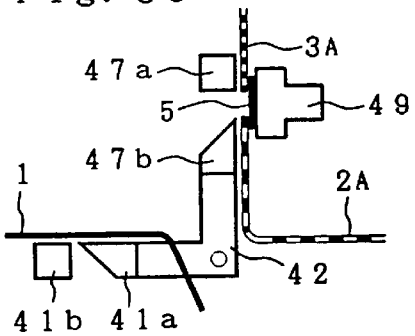
Figure 3G:
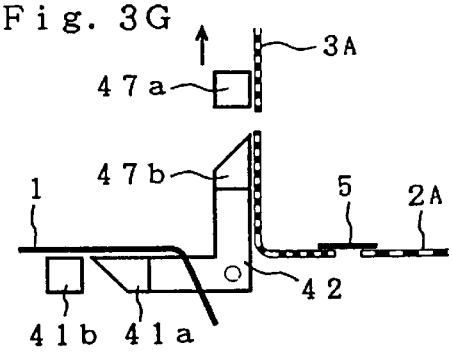
Figure 3D:
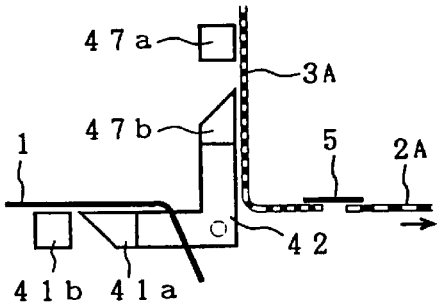
Figure 3H:
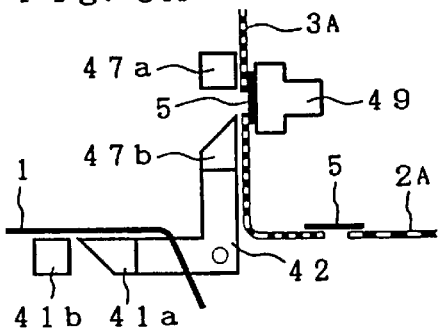
Figure 3I:
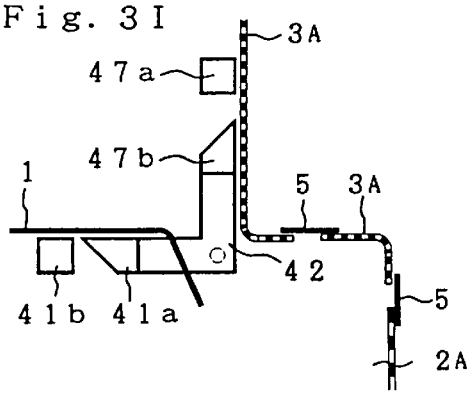
Figure 3M:
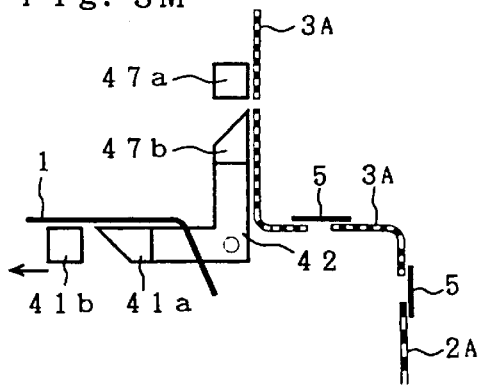
Figure 3J:
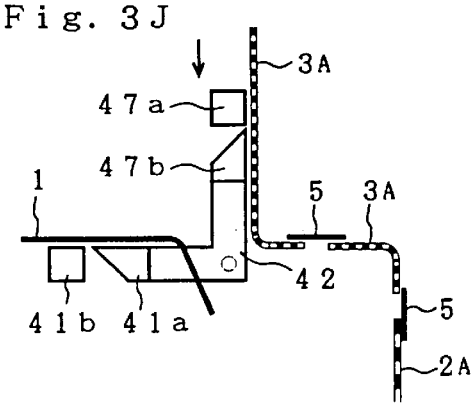
Figure 3N:
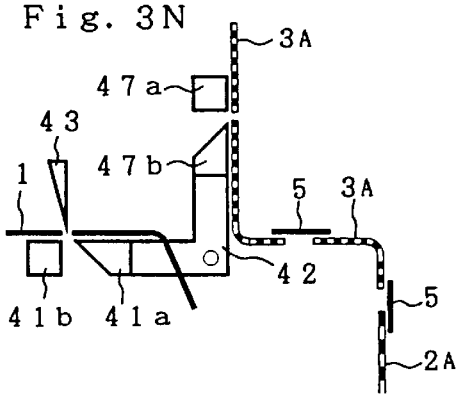
Figure 3K:
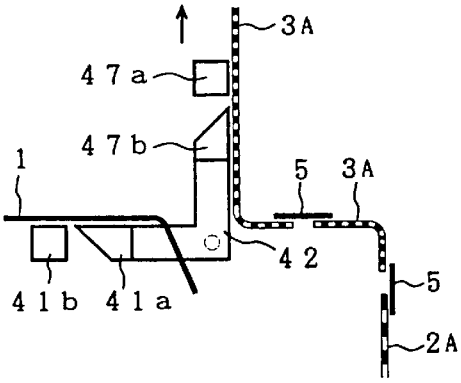
Figure 3O:
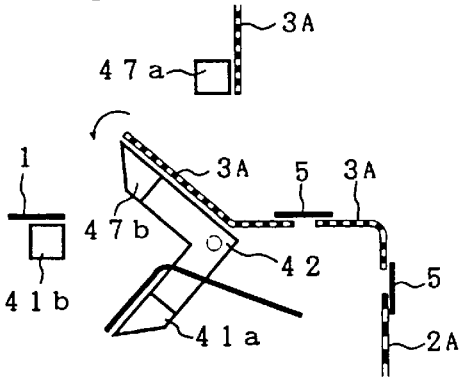
Figure 3L:
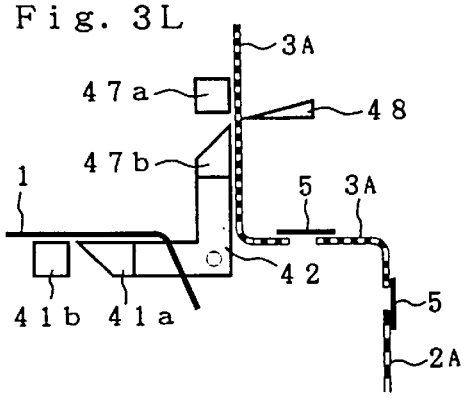
Figure 3P:
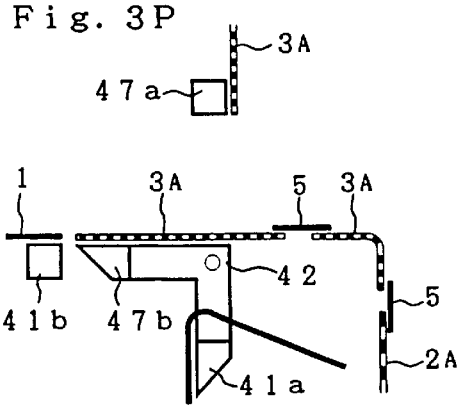
Figure 3Q:
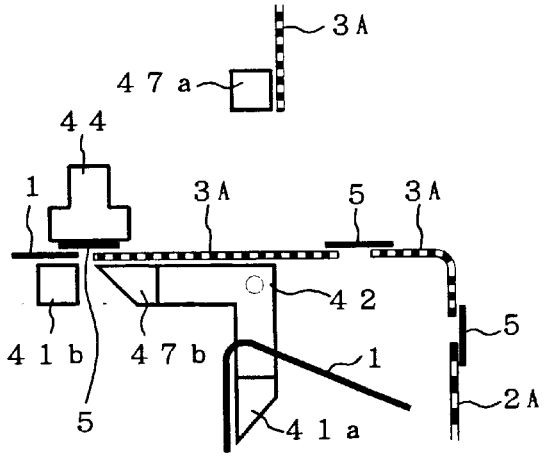
Figure 3R:
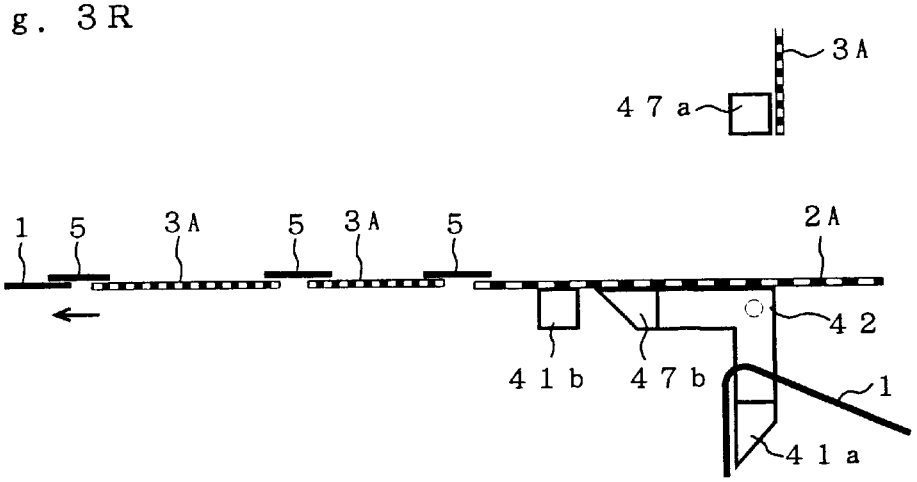
Figure 3S:
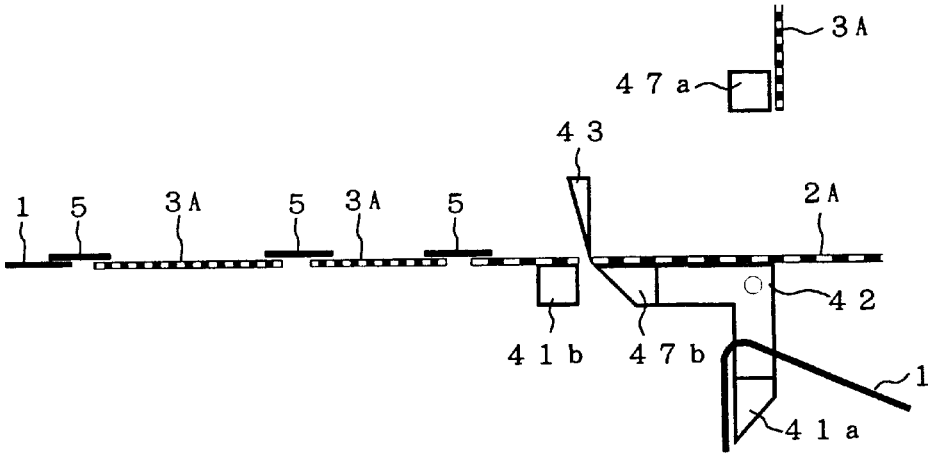
Figure 3T:
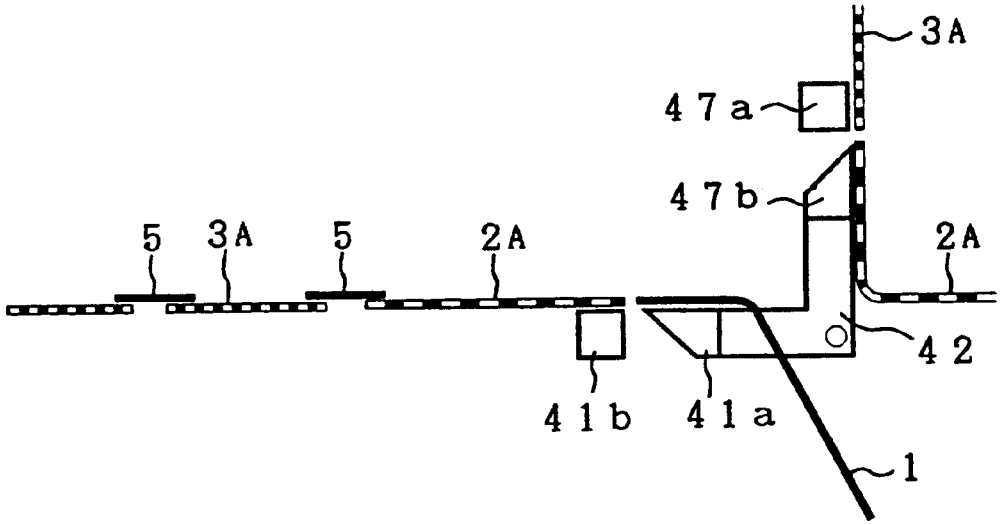
Figure 3U:
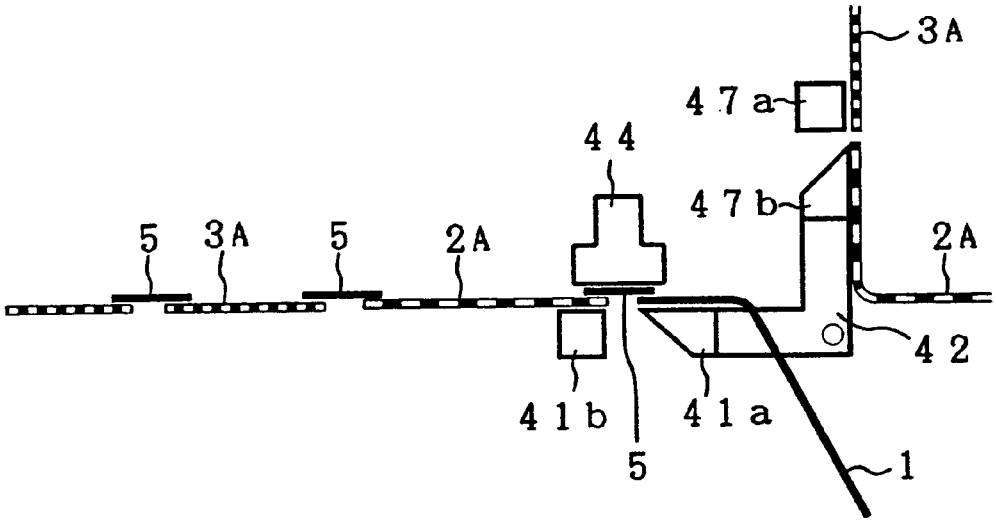

In this edit unit 40, the edit process for the ink ribbon 1 and the splice tapes 2A, 3A are conducted as shown in FIGS. 3A to 3U. First of all, the edit operation for the first and second splice tapes 2A, 3A are done as follows.

That is, the first splice tape 2A is unrolled until it passes through the cutting blade 48 and then suction-fixed on the splice tape rear-side fixing means 47*b* to be cut by the cutting blade 48, and thereby the end of the splice tape 2A is arranged to be coincident in position with the end of the splice tape rear-side fixing means 47*b*. Secondly, the second splice tape 3A is also drawn out to pass through the cutting blade 48 and suction-fixed onto the splice tape front-side fixing means 47*a* to be cut by the cutting blade 48, and thereby the end of the second splice tape 3A is set to be coincident in position with the end portion of the splice tape front-side fixing means 47*a* (see FIG. 3A).

Subsequently, the splice tape front-side fixing means 47*a* is moved upwardly in an arrow direction to enlarge the separation between the two splice tape fixing means 47*a*, 47*b* (see FIG. 3B), and through the use of the adhesive tape sticking means 49 the adhesive tape 5 is adhered to both the first and second splice tapes 2A, 3A to bridge (to be put) therebetween (see FIG. 3C). In this case, the upward movement of the splice tape front-side fixing means 47*a* in FIG. 3B is for the purpose of making a window for joining the adhesive tape 5, and the moving distance is determined in accordance with the adhesive force of the adhesive tape 5 and others, commonly approximately several millimeters.

The first and second splice tapes 2A, 3A joined to each other is returned through the feed roller 51 to the accumulator 50 side. At this time, the returning quantity is determined in accordance with the necessary length of the second splice tape 3A to be used as an intermediate tape (see FIG. 3D).

Following this, the separation between the splice tape front-side fixing means 47*a* and the splice tape rear-side fixing means 47*b* is reduced in advance (see FIG. 3E), so that the splice tape fixing means 47*a*, 47*b* suck and fix the second splice tape 3A which in turn, is cut by the cutting blade 48 (see FIG. 3F).

Then, the splice tape front-side fixing means 47*a* is again moved upwardly in the illustration to widen the separation between the splice tape fixing means 47*a*, 47*b* (see FIG. 3G), and through the use of the adhesive tape sticking means 49, the adhesive tape 5 is adhered to both the second splice tapes 3A cut to bridge therebetween (see FIG. 3H). Thus, the second splice tape 3A joined between the two adhesive tapes 5 acts as an intermediate tape 4.

Furthermore, the first and second splice tapes 2A, 3A integrally joined through the adhesive tape 5 are taken back through the feed roller 51 to the accumulator 50 side. At this time, the returning quantity is determined in accordance with the necessary length of the second splice tape 3A to be used as a leader tape (see FIG. 3I).

The splice tape front-side fixing means 47*a* is again moved downwardly as shown by an arrow (see FIG. 3J) and then slightly shifted upwardly to define a given separation between the splice tape front-side fixing means 47*a* and the splice tape rear-side fixing means 47*b* (see FIG. 3K), and further the second splice tape 3A is sucked and fixed by the splice tape fixing means 47*a*, 47*b*, and cut by the cutting blade 48 (see FIG. 3L). Thus, a portion of the cut second splice tape 3A on the accumulator 50 side serves as a leader tape.

On the other hand, while the edit process for the first and second splice tapes 2A, 3A is done as described above, the ink ribbon 1 is drawn out from the supply unit 10 and conveyed to the take-up unit 30. Further, the ribbon take-up side fixing means 41*b* is previously shifted to the take-up unit 30 side to ensure a necessary overlapping space (see FIG. 3M) whereby the angular-type rotating bed 42 is rotatable as will be described herein later (see FIG. 30). Then, the ink ribbon 1 is suction-fixed by the ribbon fixing means 41*a*, 41*b* and cut by the cutting blade 43 (see FIG. 3N).

Subsequently, in a state where the ink ribbon 1 is suction-fixed by the ribbon take-up side fixing means 41*a* and the ribbon supply side fixing mean 41*b*, and the second splice tape 3A is suction-fixed by the splice tape front side fixing means 47*a* and the splice tape rear side fixing means 47*b*, the angular-type rotating bed 42 is rotated (see FIG. 30) so that the splice tape rear-side fixing means 47*b* is disposed at a position facing the ribbon take-up side fixing means 41*b* (see FIG. 3P).

After this, through the use of the adhesive tape sticking means 44, the adhesive tape 5 is adhered to the ink ribbon 1 suction-fixed by the ribbon take-up side fixing means 41*b* and the second splice tape 3A suction-fixed by the splice tape rear-side fixing means 47*b* to bridge therebetween (see FIG. 3Q).

The ink ribbon 1 joined to the second splice tape 3A is sent to the take-up unit 30 side (see FIG. 3R). At this time, the sending quantity is determined in accordance with the length of the first splice tape 2A necessary as the trailer tape 2.

Thereafter, the first splice tape 2A is suction-fixed to the ribbon take-up side fixing means 41*b* and the splice tape rear-side fixing means 47*b* and cut by the cutting blade 43 (see FIG. 3S).

In a state where the first splice tape 2A is suction-fixed by the ribbon take-up side fixing means 41*b* and the ink ribbon 1 is suction-fixed by the ribbon supply side fixing means 41*a*, the angular-type rotating bed 42 is rotated to be returned to the original position (see FIG. 3T). Whereupon, the end of the ink ribbon 1 suction-fixed to the ribbon supply side fixing means 41*a* comes into an opposed relation to the end of the first splice tape 2A suction-fixed to the ribbon take-up side fixing means 41*b*.

In this state, through the use of the adhesive tape sticking means 44, the adhesive tape 5 is adhered to the first splice tape 2A suction-fixed to the ribbon tape-up side fixing means 41*b* and the ink ribbon 1 suction-fixed to the ribbon supply side fixing means 41*a* to bridge therebetween (see FIG. 3U).

After the ink ribbon 1 and the first and second splice tapes 2A, 3A are thus joined, the ink ribbon 1 joined to the first and second splice tapes 2A, 3A is delivered to the take-up unit 30.

Figure 8:
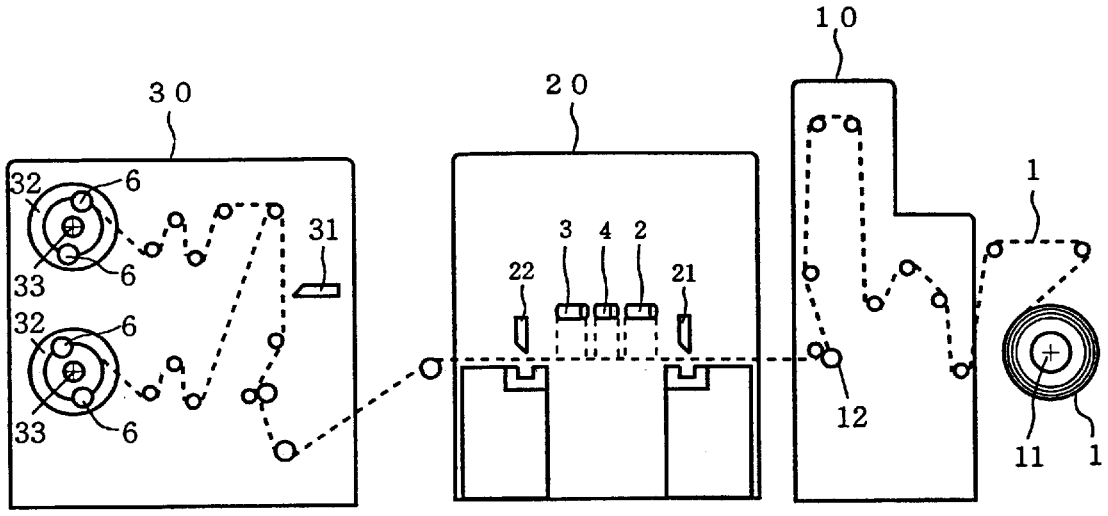
Fig. 8 PRIOR ART
FIG. 8 is an illustration of an arrangement of a prior ribbon roll manufacturing apparatus.
Figure 9A:
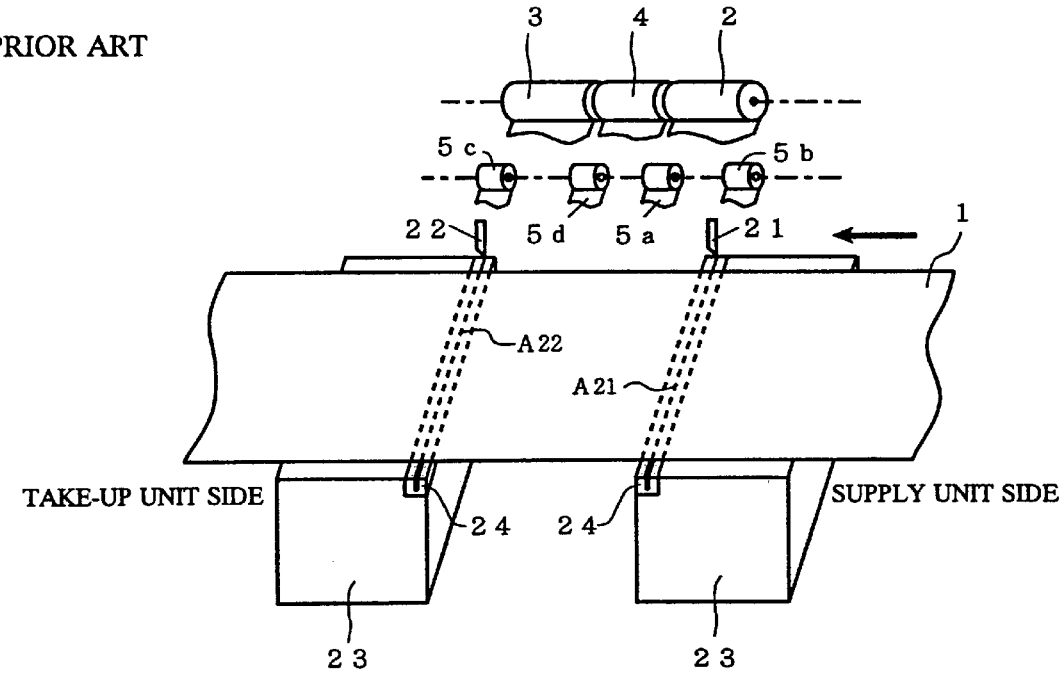
Fig. 9A PRIOR ART
FIGS. 9A and 9B are illustrations for explaining an edit process by the prior apparatus.
Figure 9B:
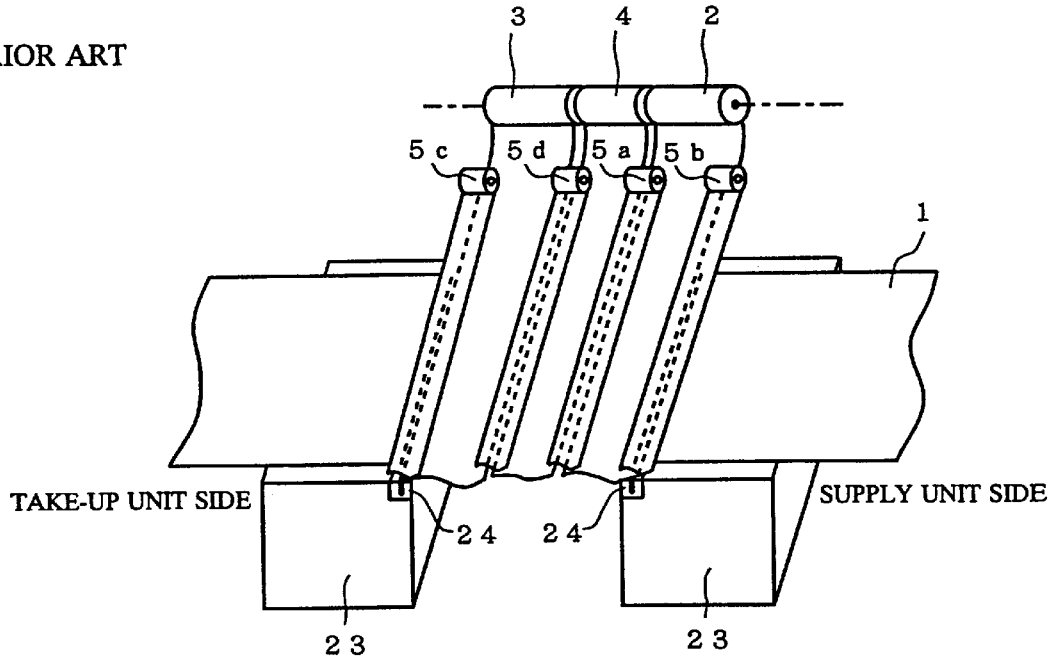
Fig. 9B PRIOR ART

The take-up unit 30 has the same arrangement as that of the prior apparatus shown in FIG. 8, and is equipped with a cutting means 31 for cutting the ink ribbon 1 from the edit unit 40 in a given width and a turret 32 for mounting cores 6 for rolling up the ink ribbon 1 cut to have the given width, with the ink ribbons 1 being rolled up around the cores 6. Further, while the ink ribbon 1 is rolled up in the take-up unit 30, the above-described edit process is repeatedly done in the edit unit 40.

When thus manufacturing an ink ribbon roll, the length of the first splice tape 2A joined as the trailer tape 2 to the ink ribbon I and the second splice tape 3A joined as the leader tape 3 or the intermediate tape 4 thereto are adjustable by merely setting the supply quantities of the respective tapes. Accordingly, unlike the prior art, the work which replaces the rolled splice tape material with one with a different tape width to change the length of the splice tape to be joined to the ink ribbon becomes unnecessary, and further the edition of the splice tape and the joining between the edited splice tape and the ink ribbon can be automatized without depending upon the manual operation. In addition, simultaneously with the edit process for the splice tape, the take-up process for the ink ribbon 1 can be done, with the result that the productivity on the ink ribbon is greatly improvable.

Although a description has been made above of the apparatus and method according to this invention which manufactures an ink ribbon roll (FIG. 7) in which the take-up operation starts from the trailer tape 2 and ends at the leader tape 3, this invention is not limited to these apparatus and method.

For instance, this invention covers an apparatus and method for manufacturing an ink ribbon roll (the trailer tape 2 is omitted from the ink ribbon roll shown in FIG. 7) in which the trailer tape is not used and the take-up operation directly starts from the ink ribbon but not from the trailer tape and ends at the leader tape. This apparatus will be described with reference to FIG. 4, and the method based upon the apparatus will be described with reference to FIGS. 5A to 5J. The description thereof will be made in the case that a leader tape 3 and an intermediate tape 4 are made with a single splice tape 2A.

Figure 4:
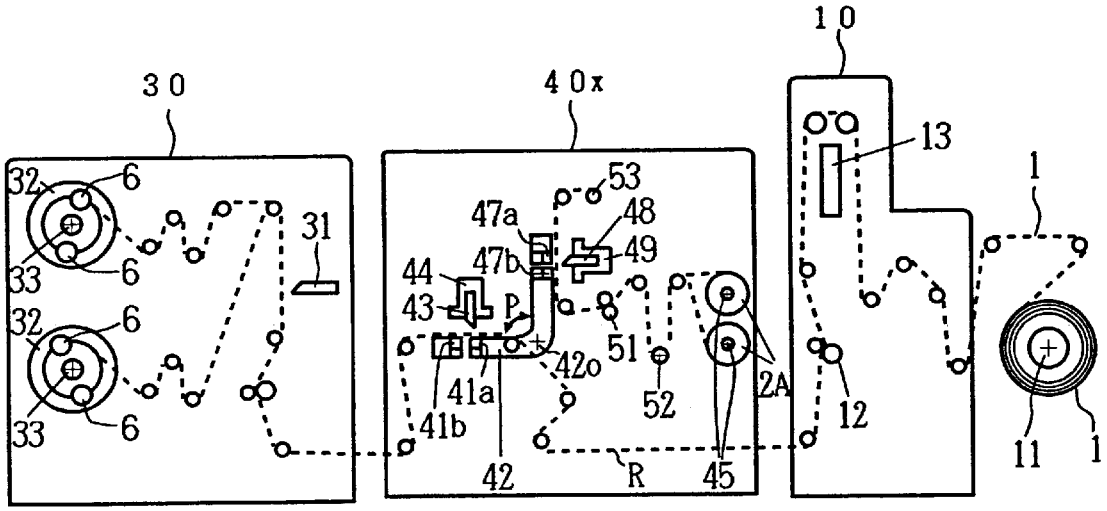
FIG. 4 is an illustration of an arrangement of a ribbon roll manufacturing apparatus according to this invention.

As well as the FIG. 1 apparatus, the FIG. 4 apparatus is composed of a supply unit 10, an edit unit 40*x* and a take-up unit 30. In the edit unit 40*x* of this apparatus, the winding shaft 46 for the second splice tape 3A and the conveyance mechanism attendant on it are omitted from the edit unit 40 of the FIG. 1 apparatus, while, as a feed adjusting means, a dancer roller 52 is provided in place of the accumulator 50 and a take-up roller 53 is placed therein. Incidentally, as the feed adjusting means, it is also appropriate that a rewinding function is given to a winding shaft for the splice tape 2A without using the dancer roller 52.

In the edit unit 40*x* in FIG. 4, the edit process for the ink ribbon 1 and the splice tape 2A is done as shown in FIGS. 5A to 5J. First of all, the splice tape 2A is rolled up by the take-up roller 53 to pass a cutting blade 48, and further drawn out by a given length and suction-fixed to a splice tape front-side fixing means 47*a* and a splice tape rear-side fixing means 47*b* (see FIG. 5A) to be cut by the cutting blade 48 (see FIG. 5B). Thus, the tip portion side of the cut splice tape 2A serves as a leader tape (3).

Figure 5A:
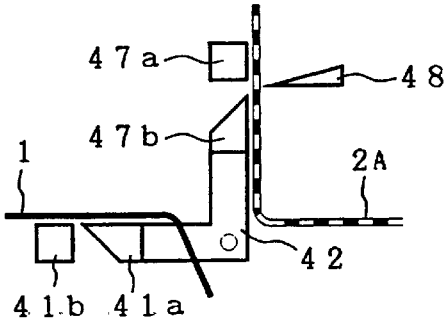
FIGS. 5A to 5J are illustrations useful for explaining an edit process in a ribbon roll manufacturing method according to this invention.
Figure 5D:
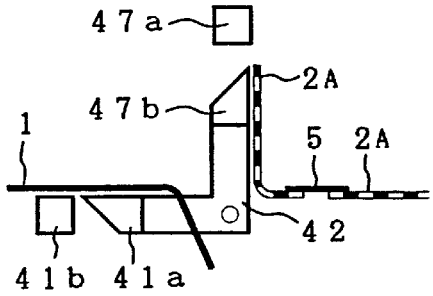
Figure 5B:
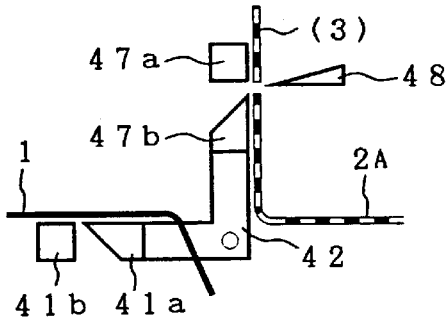
Figure 5E:
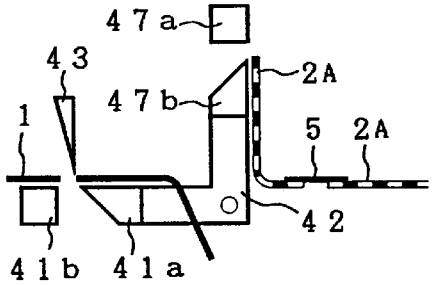
Figure 5C:
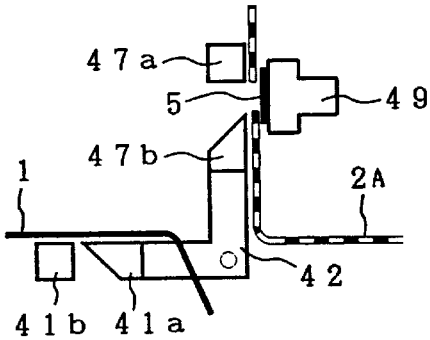

Secondly, the separation between the splice tape front-side fixing means 47*a* and the splice tape rear-side fixing means 47*b* is enlarged, and through the use of an adhesive tape sticking means 49, an adhesive tape 5 is adhered to the cut splice tape 2A to bridge therebetween (see FIG. 5C). Further, after being released from the fixing to the splice tape front-side fixing means 47*a* and the splice tape rear-side fixing means 47*b*, the splice tape 2A is rewound on the dancer roller 52 to put the tip portion of the splice tape 2A to coincide in position with the end portion of the splice tape rear-side fixing means 47*b* on the splice tape front-side fixing means 47*a* side, where the splice tape 2A is again suction-fixed (see FIG. 5D).

On the other hand, while the edit operation is thus conducted for the splice tape 2A, the ink ribbon 1 is drawn out by a given length from the supply unit 10 and then conveyed to the take-up unit 30. Further, as in the case of manufacturing an ink ribbon roll in the FIG. 1 apparatus, the ink ribbon 1 is suction-fixed by a ribbon supply side fixing means 41*a* and a ribbon take-up side fixing means 41*b*, and then cut by a cutting blade 43 (see FIG. 5E).

Figure 5F:
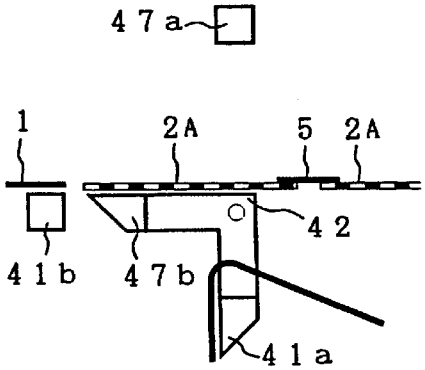

Subsequently, the ink ribbon 1 is suction-fixed by the ribbon supply side fixing means 41*a* and the ribbon take-up side fixing means 41*b*, and in a state where the splice tape 2A is suction-fixed by the splice tape rear-side fixing means 47*b*, an angular-type rotating bed 42 is rotated so that splice tape rear-side fixing means 47*b* faces the ribbon take-up side fixing means 41*b* (see FIG. 5F).

Figure 5G:
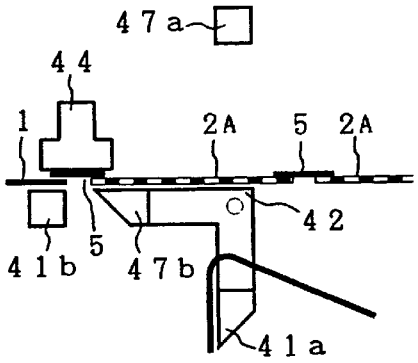

Following this, through the use of an adhesive tape sticking means 44, an adhesive tape 5 is adhered to the ink ribbon 1 suction-fixed to the ribbon take-up side fixing means 41*b* and the splice tape 2A suction-fixed to the splice tape rear-side fixing means 47*b* to bridge therebetween (FIG. 5G). The ink ribbon thus joined to the splice tape 2A is delivered to the take-up unit 30 side. At the feeding quantity is determined in accordance with the length of the splice tape 2A necessary as the intermediate tape (4).

Figure 5H:
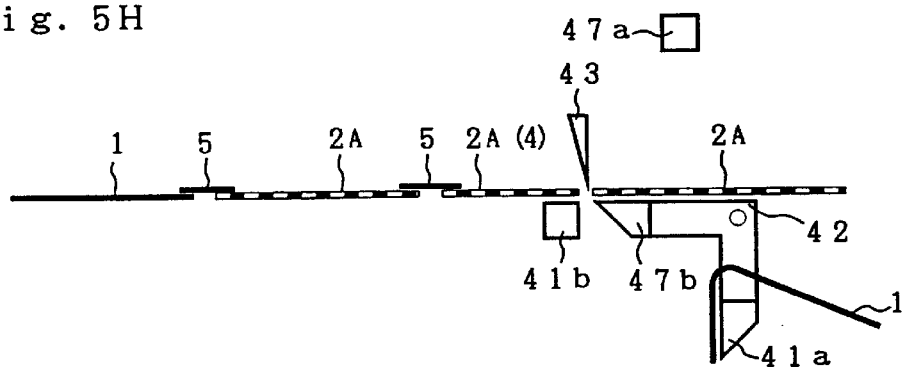

After this, the splice tape 2A is suction-fixed to the splice tape rear-side fixing means 47*b* and the ribbon take-up side fixing means 41*b*, and then cut by the cutting blade 43 (see FIG. 5H).

Figure 5I:
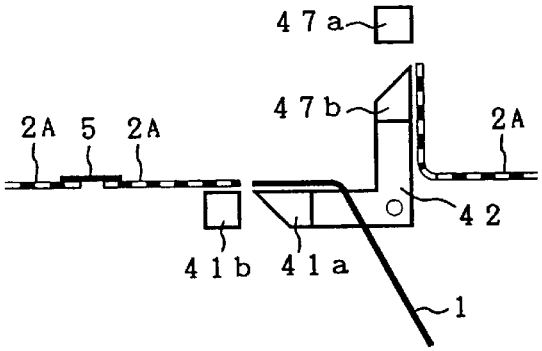

In a state where the splice tape 2A is suction-fixed by the ribbon take-up side fixing means 41*b* and the ink ribbon 1 is suction-fixed by the ribbon supply side fixing means 41*a*, the angular-type rotating bed 42 is rotated to return to the original position (see FIG. 5I). Whereupon, the end portion of the ink ribbon 1 suction-fixed to the ribbon supply side fixing means 41*a* comes into an opposed relation to the end portion of the splice tape 2A suction-fixed to the ribbon take-up side fixing means 41*b*.

Figure 5J:
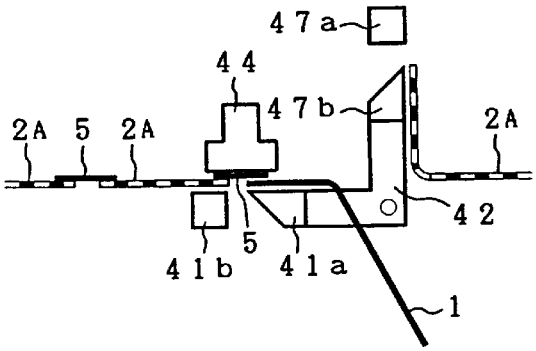

In this state, through the use of the adhesive tape sticking means 44, an adhesive tape 5 is adhered to the splice tape 2A suction-fixed to the ribbon take-up side fixing means 41*b* and the ink ribbon 1 suction-fixed to the ribbon supply side fixing means 41*a* to bridge therebetween (see FIG. 5J).

After the joining the ink ribbon 1 and the splice tape 2A, the ink ribbon 1 joined to the splice tape 2A is delivered to the take-up unit 30.

In the take-up unit 30, the ink ribbon 1 is cut by a cutting section 31 to have a given width, and then rolled up around the core 6. Further, while the ink ribbon 1 is wound in the take-up unit 30, the above-described edit process for the splice tape 2A is repeatedly done.

Figure 6:
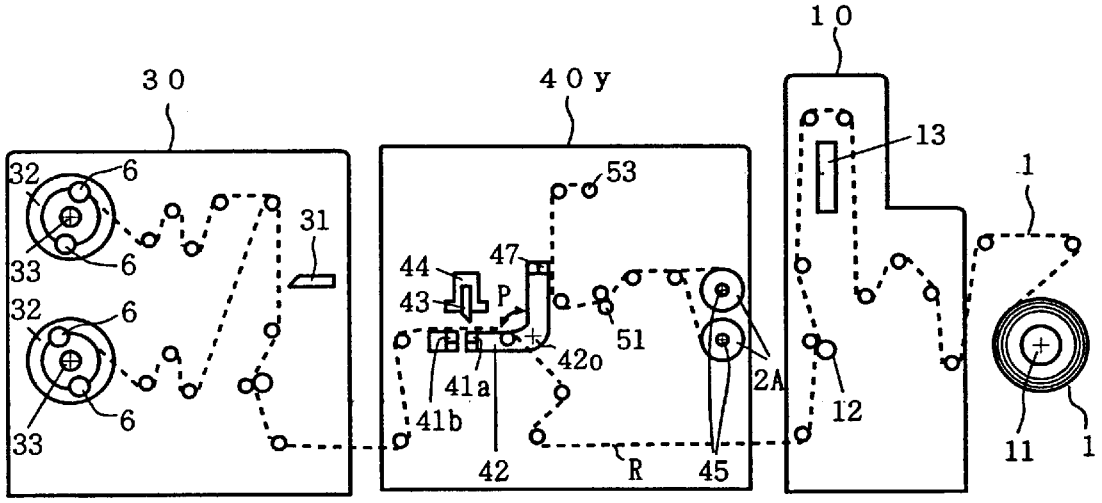
FIG. 6 is an illustration of an arrangement of a ribbon roll manufacturing apparatus according to this invention.

Although a description has been made above of the apparatus and method according to this invention which manufacture an ink ribbon roll in which the ink ribbon winding directly starts from the ink ribbon with no trailer tape and ends at the leader tape, this invention is also applicable to a method of manufacturing an ink ribbon with neither trailer tape nor leader tape. FIG. 6 is an illustration of an arrangement of an apparatus which carries out a first method of manufacturing such an ink ribbon roll according to this invention. Incidentally, in the FIG. 6 apparatus, a splice tape 2A to be joined to an ink ribbon is used as a released tape for an adhesive tape 5 to be used at the winding start and end in rolling up the ink ribbon 1 around a core 6 in a take-up unit 30, and it is not left in the manufactured ink ribbon roll.

As well as the apparatus according to this invention shown in FIGS. 1 and 4, the FIG. 6 apparatus is made up of a supply unit 10, an edit unit 40*y* and a take-up unit 30. In this apparatus, the edit unit 40*y* is constructed such that the edit unit 40*x* of the FIG. 4 apparatus according to this invention is further simplified and the cutting blade 48 being a splice tape cutting means and the dancer roller 52 being a feed adjusting means are omitted therefrom.

In the case of manufacturing an ink ribbon roll with neither trailer tape nor leader tape through the use of this FIG. 6 apparatus, in the edit unit 40*y*, the edit process for an ink ribbon 1 and a splice tape 2A being an intermediate tape are conducted as follows according to the edit process described above with reference to FIGS. 5A to 5J.

First of all, the splice tape 2A is sent up to a splice tape fixing means 47 and is suction-fixed here. On the other hand, an ink ribbon 1 is unrolled by a given length from the supply unit 10 and then conveyed to the take-up unit 30. Further, as in the case of manufacturing an ink ribbon roll with the FIG. 1 apparatus, the ink ribbon 1 is suction-fixed by a ribbon supply side fixing means 41*a* and a ribbon take-up side fixing means 41*b* to be cut by a cutting blade 43.

Subsequently, in a state where the ink ribbon 1 is suction-fixed to the ribbon supply side fixing means 41*a* and the ribbon take-up side fixing means 41*b* and the splice tape 2A is suction-fixed to the splice tape fixing means 47, an angular-type rotating bed 42 is rotated so that the splice tape fixing means 47 faces the ribbon take-up side fixing means 41*b* (see FIG. 5F). Then, through the use of an adhesive tape sticking means 44, an adhesive tape 5 is adhered to the ink ribbon 1 suction-fixed to the ribbon take-up side fixing means 41*b* and the splice tape 2A suction-fixed to the splice tape fixing means 47 to bridge therebetween (see FIG. 5G). Thus, the ink ribbon 1 joined to the splice tape 2A is delivered to the take-up unit 30 side. At this time, the feeding quantity is determined in accordance with the length of the splice tape 2A necessary as the intermediate tape 4.

Following this, the splice tape 2A is suction-fixed by the ribbon supply side fixing means 41*a* and the ribbon take-up side fixing means 41*b* and then cut by the cutting blade 43 (see FIG. 5H). Further, in a state where the splice tape 2A is suction-fixed to the ribbon take-up side fixing means 41*b* and the ink ribbon 1 is suction-fixed to the ribbon supply side fixing means 41*a*, the angular-type rotating bed 42 is rotated to return to the original position (see FIG. 5I). Whereupon, the end of the ink ribbon 1 suction-fixed to the ribbon supply side fixing means 41*a* comes into an opposed relation to the end of the splice tape 2A suction-fixed to the ribbon take-up side fixing means 41*b*.

In this state, through the use of the adhesive tape sticking means 44, an adhesive tape 5 is adhered to the splice tape 2A suction-fixed to the ribbon take-up side fixing means 41*b* and the ink ribbon 1 suction-fixed to the ribbon supply side fixing means 41*a* to bridge therebetween (see FIG. 5J).

After the joining between the ink ribbon 1 and the splice tape 2A, the ink ribbon 1 joined to the splice tape 2A is delivered to the take-up unit 30.

In the take-up unit 30, the ink ribbon 1 is cut by a cutting section to have a given width, and then rolled up around a core 6. Further, while the ink ribbon is rolled up in the take-up unit 30, the above-described edit process is repeatedly done.

Although as the embodiments of this invention a description has been made above of three cases of manufacturing an ink ribbon roll, this invention is also applicable to various cases of manufacturing ink ribbon rolls in a splice tape joining way. In addition, this invention is not limited to the case of manufacturing an ink ribbon roll, but is widely applicable to manufacturing a ribbon roll including a splice tape joined.

According to this invention, in manufacturing a ribbon roll in which a splice tape is joined to a ribbon, the edit process for joining the splice tape and the ribbon can be automatized to also cope with splice tapes different in length and kind, and the productivity on the ribbon roll is improvable.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. A method of manufacturing a ribbon roll, comprising:

(I) a ribbon supply process of drawing out and supplying a ribbon from a rolled ribbon material made by rolling up said ribbon;

(II) an edit process of cutting the supplied ribbon along its width direction and further of joining a splice tape with a given length to the cut ribbon so that said splice tape is put between the cut ribbon sections; and (III) a take-up process of rolling up said ribbon in a state where said splice tape is interposed between the cut ribbon sections, wherein said edit process (II) comprising:

(1) a splice tape edit step of drawing out said splice tape from a rolled splice tape material made by rolling up said splice tape to temporarily fix an end portion of said splice tape drawn out therefrom to a splice tape fixing means;

(2) a ribbon conveyance step of conveying said ribbon with a given length from a supply unit to a take-up unit and then of temporarily fixing said ribbon to a ribbon supply side fixing means and a ribbon take-up side fixing means which are disposed to made a separation therebetween in the ribbon conveyance path and further of cutting said ribbon at a position between said ribbon supply side fixing means and said ribbon take-up side fixing means; and (3) a joining step between said splice tape and said ribbon, including the steps of:

moving said splice tape fixing means and said ribbon supply side fixing means so that said ribbon supply side fixing means to which said ribbon is fixed is replaced with said splice tape fixing means to which the end portion of said splice tape is fixed;

joining said ribbon fixed to said ribbon take-up side fixing means to said splice tape fixed to said splice tape fixing means;

releasing said ribbon and said splice tape from the fixing on said ribbon take-up side fixing means and said splice tape fixing means, respectively, to deliver said ribbon joined to said splice tape by a given length in a ribbon take-up direction;

temporarily fixing said splice tape to said ribbon take-up side fixing means and further to said splice tape fixing means to cut said splice tape between said ribbon take-up side fixing means and said splice tape fixing means;

moving said ribbon supply side fixing means and said splice tape fixing means so that said splice tape fixing means to which said splice tape is fixed is replaced with said ribbon supply side fixing means to which said ribbon is fixed; and joining said splice tape fixed to said ribbon take-up side fixing means to said ribbon fixed to said ribbon supply side fixing means.

2. A method of manufacturing a ribbon roll as defined in claim 1, wherein, in said joining step (3) between said splice tape and said ribbon, said splice tape fixing means and said ribbon supply side fixing means are located on a rotating bed to be at the same distance with respect to a rotary shaft of said rotating bed, and these fixing means are moved so that, when said rotating bed is rotated, said splice tape fixing means is replaced with said ribbon supply side fixing means, or said ribbon supply side fixing means is replaced with said splice tape fixing means.

3. A method of manufacturing a ribbon roll as defined in claim 2, wherein said rotating bed is an angular-type rotating bed having an intermediately bent cross-sectional configuration.

4. A method of manufacturing a ribbon roll as defined in any one of claims 1 to 3, wherein, in said joining step (3) between said splice tape and said ribbon, the joining between said ribbon and said splice tape is made through a one-sided adhesive tape.

5. A method of manufacturing a ribbon roll, comprising:

(I) a ribbon supply process of drawing out and supplying a ribbon from a rolled ribbon material made by rolling up said ribbon;

(II) an edit process of cutting the supplied ribbon along its width direction and further of joining a splice tape with a given length to the cut ribbon so that said splice tape is put between the cut ribbon sections; and (III) a take-up process of rolling up said ribbon in a state where said splice tape is interposed between the cut ribbon sections, wherein said edit process (II) comprising:

(1) a splice tape edit step including the steps of:

drawing out said splice tape from a rolled splice tape material made by rolling up said splice tape to temporarily fix an end portion of said splice tape drawn out therefrom to a splice tape fixing means, with said splice tape fixing means being composed of splice tape front-side fixing means and splice tape rear-side fixing means which are disposed to make a separation therebetween in a splice tape conveyance path, and said splice tape rear-side fixing means being placed on the rolled splice tape material side with respect to said splice tape front-side fixing means;

cutting said splice tape at a position between said splice tape rear-side fixing means and said splice tape front-side fixing means;

joining said splice tape cut into two portions;

releasing said splice tape from the fixing to said splice tape fixing means to return said splice tape so that an end portion of said splice tape on said splice tape front-side fixing means coincides in position with an end portion of said splice tape rear-side fixing means on the splice tape front-side fixing means side; and temporarily fixing said splice tape onto said splice tape rear-side fixing means again;

(2) a ribbon conveyance step of conveying said ribbon with a given length from a supply unit to a take-up unit and then of temporarily fixing said ribbon to a ribbon supply side fixing means and a ribbon take-up side fixing means which are disposed to made a separation therebetween in the ribbon conveyance path and further of cutting said ribbon at a position between said ribbon supply side fixing means and said ribbon take-up side fixing means; and (3) a joining step between said splice tape and said ribbon, including the steps of:

moving said splice tape rear-side fixing means and said ribbon supply side fixing means so that said ribbon supply side fixing means to which said ribbon is fixed is replaced with said splice tape rear-side fixing means to which said splice tape is fixed;

joining said ribbon fixed to said ribbon take-up side fixing means to said splice tape fixed to said splice tape rear-side fixing means;

releasing said ribbon and said splice tape from the fixing on said ribbon take-up side fixing means and said splice tape rear-side fixing means, respectively;

delivering said ribbon joined to said splice tape by a given length in a ribbon take-up direction;

temporarily fixing said splice tape to said ribbon take-up side fixing means and further to said splice tape rear-side fixing means to cut said splice tape between said ribbon take-up side fixing means and said splice tape rear-side fixing means;

moving said ribbon supply side fixing means and said splice tape rear-side fixing means so that said splice tape rear-side fixing means to which said splice tape is fixed is replaced with said ribbon supply side fixing means to which said ribbon is fixed; and joining said splice tape fixed to said ribbon take-up side fixing means to said ribbon fixed to said ribbon supply side fixing means.

6. A method of manufacturing a ribbon roll as defined in claim 5, wherein, in said joining step (3) between said splice tape and said ribbon, said splice tape rear-side fixing means and said ribbon supply side fixing means are located on a rotating bed to be at the same distance with respect to a rotary shaft of said rotating bed, and these fixing means are moved so that, when said rotating bed is rotated, said splice tape rear-side fixing means is replaced with said ribbon supply side fixing means, or said ribbon supply side fixing means is replaced with said splice tape rear-side fixing means.

7. A method of manufacturing a ribbon roll as defined in claim 6, wherein said rotating bed is an angular-type rotating bed having an intermediately bent cross-sectional configuration.

8. A method of manufacturing a ribbon roll as defined in any one of claims 5 to 7, wherein the joining between said splice tape portions in said splice tape edit step (1) and the joining between said ribbon and said splice tape in said joining step (3) are made through a one-sided adhesive tape.

9. A method of manufacturing a ribbon roll, comprising:

(I) a ribbon supply process of drawing out and supplying a ribbon from a rolled ribbon material made by rolling up said ribbon;

(II) an edit process of cutting the supplied ribbon along its width direction and further of joining a splice tape comprising first and second splice tapes having given lengths to the cut ribbon so that said splice tape is put between the cut ribbon sections; and (III) a take-up process of rolling up said ribbon in a state where said splice tape is interposed between the cut ribbon sections, wherein said edit process (II) comprising:

(1) a splice tape edit step including the steps of:

drawing out said first splice tape from a rolled splice tape material made by rolling up said first splice tape to temporarily fix an end portion of said first splice tape through a feed adjusting means to a splice tape rear-side fixing means, said splice tape rear-side fixing means together with a splice tape front-side fixing means constituting a splice tape fixing means, and said splice tape rear-side fixing means being disposed on the rolled splice tape material side with respect to said splice tape front-side fixing means to make a separation therebetween;

drawing out said second splice tape from a rolled splice tape material made by rolling up said second splice tape;

temporarily fixing one end portion of said second splice tape to said splice tape front-side fixing means;

joining said second splice tape fixed to said splice tape front-side fixing means to said first splice tape fixed to said splice tape rear-side fixing means;

releasing said second splice tape from the fixing to said splice tape front-side fixing means and said first splice tape from the fixing on said splice tape rear-side fixing means to return said splice tape resulting from the joining between said first and second splice tapes by a given length in a direction opposite to the first splice tape drawn direction through the use of said feed adjusting means;

temporarily fixing said second splice tape onto said splice tape front-side fixing means and said splice tape rear-side fixing means;

cutting said second splice tape at a position between said splice tape front-side fixing means and said splice tape rear-side fixing means;

joining the cut second splice tape to return the joined second splice tape in a direction opposite to the first splice tape drawn direction through the use of said feed adjusting means; and temporarily fixing said second splice tape onto said splice tape front-side fixing means and said splice tape rear-side fixing means to cut said second splice tape at a position between said splice tape front-side fixing means and said splice tape rear-side fixing means;

(2) a ribbon conveyance step of conveying said ribbon with a given length from a supply unit to a take-up unit and then of temporarily fixing said ribbon to a ribbon supply side fixing means and a ribbon take-up side fixing means which are disposed to made a separation therebetween in the ribbon conveyance path and further of cutting said ribbon at a position between said ribbon supply side fixing means and said ribbon take-up side fixing means; and (3) a joining step between said splice tape and said ribbon, including the steps of:

moving said splice tape rear-side fixing means and said ribbon supply side fixing means so that said ribbon supply side fixing means to which said ribbon is fixed is replaced with said splice tape rear-side fixing means to which said second splice tape is fixed;

joining said ribbon fixed to said ribbon take-up side fixing means to said second splice tape fixed to said splice tape rear-side fixing means;

releasing said ribbon and said second splice tape from the fixing on said ribbon take-up side fixing means and said splice tape rear-side fixing means, respectively;

delivering said ribbon joined to said second splice tape by a given length in a ribbon take-up direction;

temporarily fixing said first splice tape to said ribbon take-up side fixing means and further to said splice tape rear-side fixing means to cut said first splice tape between said ribbon take-up side fixing means and said splice tape rear-side fixing means;

moving said ribbon supply side fixing means and said splice tape rear-side fixing means so that said splice tape rear-side fixing means to which said first splice tape is fixed is replaced with said ribbon supply side fixing means to which said ribbon is fixed; and joining said first splice tape fixed to said ribbon take-up side fixing means to said ribbon fixed to said ribbon supply side fixing means.

10. A method of manufacturing a ribbon roll as defined in claim 9, wherein, in said joining step (3) between said splice tape and said ribbon, said splice tape rear-side fixing means and said ribbon supply side fixing means are located on a rotating bed to be at the same distance with respect to a rotary shaft of said rotating bed, and these fixing means are moved so that, when said rotating bed is rotated, said splice tape rear-side fixing means is replaced with said ribbon supply side fixing means, or said ribbon supply side fixing means is replaced with said splice tape rear-side fixing means.

11. A method of manufacturing a ribbon roll as defined in claim 10, wherein said rotating bed is an angular-type rotating bed having an intermediately bent cross-sectional configuration.

12. A method of manufacturing a ribbon roll as defined in any one of claims 9 to 11, wherein the joining of said splice tape in said splice tape edit step (1) and the joining between said ribbon and said splice tape in said joining step (3) are made through a one-sided adhesive tape.

13. An apparatus for manufacturing a ribbon roll, comprising:

(I) a ribbon supply unit for drawing out and supplying a ribbon from a rolled ribbon material made by rolling up said ribbon;

(II) an edit unit for cutting the supplied ribbon along its width direction and further of joining a splice tape with a given length to the cut ribbon so that said splice tape is put between the cut ribbon sections; and (III) a take-up unit for rolling up said ribbon around a core in a state where said splice tape is interposed between the cut ribbon sections, wherein said edit unit (II) comprising:

a splice tape supply section for drawing out said splice tape from a rolled splice tape material made by rolling up said splice tape a splice tape fixing means for temporarily fix an end portion of said splice tape drawn out therefrom;

ribbon supply side fixing means and ribbon take-up side fixing means disposed in a ribbon conveyance path from said supply unit to said take-up unit to make a separation therebetween;

a ribbon cutting means for cutting said ribbon or said splice tape at a position between said ribbon supply side fixing means and said ribbon take-up side fixing means;

a moving means of fixing means for moving said splice tape fixing means and said ribbon supply side fixing means so that said ribbon supply side fixing means is replaced with said splice tape fixing means, and further for returning said ribbon supply side fixing means and said splice tape fixing means to the original positions; and a tape joining means for joining said ribbon fixed to said ribbon take-up side fixing means to said splice tape fixed to said splice tape fixing means, and further for joining said splice tape fixed to said ribbon take-up side fixing means to said ribbon fixed to said ribbon supply side fixing means.

14. A ribbon roll manufacturing apparatus as defined in claim 13, wherein said splice tape fixing means is composed of splice tape front-side fixing means and splice tape rear-side fixing means which are disposed to make a separation therebetween in a splice tape conveyance path, with said splice tape rear-side fixing means being placed on a rolled splice tape material side with respect to said splice tape front-side fixing means, and further includes a tape cutting means for cutting said splice tape at a position between said splice tape front-side fixing means and said splice tape rear-side fixing means, and a feed adjusting means for returning said splice tape on said splice tape fixing means in a direction opposite to the splice tape drawn direction.

15. A ribbon roll manufacturing apparatus as defined in claim 14, wherein said splice tape supply section includes a first splice tape supply means for drawing out and supplying a first splice tape and a second splice tape supply means for drawing out and supplying a second splice tape, said feed adjusting means being place between said first splice tape supply means and said splice tape rear-side fixing means.

16. A ribbon roll manufacturing apparatus as defined in claim 14 or 15, wherein said feed adjusting means is composed of one of a dancer roller and an accumulator.

17. A ribbon roll manufacturing apparatus as defined in claim 13, wherein said moving means of fixing means is composed of a rotating bed.

18. A ribbon roll manufacturing apparatus as defined in claim 17, wherein said rotating bed is an angular-type rotating bed having an intermediately bent configuration.

* * * * *